US008723637B2

(12) United States Patent
Downey et al.

(10) Patent No.: US 8,723,637 B2
(45) Date of Patent: May 13, 2014

(54) METHOD FOR ALTERING ELECTRICAL AND THERMAL PROPERTIES OF RESISTIVE MATERIALS

(75) Inventors: Fergus John Downey, Naas (IE); Neville Craig, Collooney (IE); Patrick McGuinness, Pallaskenry (IE); Patrick Elebert, Co. Tipperary (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 13/553,894

(22) Filed: Jul. 20, 2012

(65) Prior Publication Data

US 2013/0265133 A1 Oct. 10, 2013

Related U.S. Application Data

(60) Provisional application No. 61/622,297, filed on Apr. 10, 2012.

(51) Int. Cl.
*H01C 10/00* (2006.01)

(52) U.S. Cl.
USPC ..... 338/195

(58) Field of Classification Search
USPC ..... 338/195
See application file for complete search history.

(56) References Cited

U.S. PATENT DOCUMENTS

| | | | | |
|---|---|---|---|---|
| 3,603,768 | A | | 9/1971 | Ireland et al. |
| 4,210,996 | A | | 7/1980 | Amemiya et al. |
| 4,467,312 | A | | 8/1984 | Komatsu |
| 4,505,032 | A | | 3/1985 | Praria |
| 4,606,781 | A | | 8/1986 | Vyne |
| 4,713,680 | A | | 12/1987 | David et al. |
| 4,714,911 | A | * | 12/1987 | Di Mino et al. ..... 338/195 |
| 4,901,052 | A | * | 2/1990 | Chapel et al. ..... 338/308 |
| 5,015,989 | A | | 5/1991 | Wohlfarth et al. |
| 5,635,893 | A | | 6/1997 | Spraggins et al. |
| 6,246,243 | B1 | | 6/2001 | Audy |
| 6,636,143 | B1 | | 10/2003 | Hashimoto et al. |
| 7,084,691 | B2 | | 8/2006 | Hsu |
| 7,119,656 | B2 | | 10/2006 | Landsberger et al. |
| 7,239,006 | B2 | | 7/2007 | Coolbaugh et al. |
| 7,598,841 | B2 | | 10/2009 | McGuiness et al. |
| 7,719,403 | B2 | | 5/2010 | McGuiness et al. |

(Continued)

FOREIGN PATENT DOCUMENTS

| | | |
|---|---|---|
| EP | 0 033 155 A1 | 8/1981 |
| JP | 06-084621 | 3/1994 |

(Continued)

OTHER PUBLICATIONS

PCT International Search Report and Written Opinion of related application PCT/US2011/056909 dated Jan. 31, 2012.

(Continued)

*Primary Examiner* — Kyung Lee
(74) *Attorney, Agent, or Firm* — Kenyon & Kenyon, LLP

(57) ABSTRACT

A method for altering a resistance of a resistor including trimming the resistor using a first type of trim approach to increase a resistance measurement of the resistor to above a target resistance value, and iteratively trimming the resistor using a second type of trim approach until a power coefficient of resistance (PCR) or temperature coefficient of resistance (TCR) measurement of the resistor is substantially close to zero.

19 Claims, 4 Drawing Sheets

(56) References Cited

U.S. PATENT DOCUMENTS

| | | | |
|---|---|---|---|
| 2005/0001241 | A1 | 1/2005 | Doyle |
| 2005/0062583 | A1 | 3/2005 | Naumov et al. |
| 2006/0028894 | A1 | 2/2006 | Brennan et al. |
| 2010/0101077 | A1 | 4/2010 | Grudin et al. |
| 2012/0001679 | A1 | 1/2012 | Privitera et al. |
| 2012/0098593 | A1 | 4/2012 | Downey et al. |

FOREIGN PATENT DOCUMENTS

| | | | |
|---|---|---|---|
| SU | 834 784 | A1 | 5/1981 |
| SU | 1 092 576 | A1 | 5/1984 |
| WO | 86/02492 | A1 | 4/1986 |
| WO | 91/13448 | A1 | 9/1991 |
| WO | 2005/004207 | | 1/2005 |

OTHER PUBLICATIONS

Feldbaumer et al., "Pulse Current Trimming of Polysilicon Resistors", Transactions on Electron Devices, vol. 42, No. 4, Apr. 1995,pp. 689-695.

U.S. Appl. No. 13/553,894, filed Jul. 20, 2012, titled "Method for Altering Electrical and Thermal Properties of Resistive Materials".

PCT International Search Report and Written Opinion for PCT/US2013/033134 mailed on Jun. 13, 2013.

* cited by examiner

METHOD FOR ALTERING ELECTRICAL AND THERMAL PROPERTIES OF RESISTIVE MATERIALS

CROSS-REFERENCE TO RELATED APPLICATION

The present application claims priority from U.S. Provisional Application No. 61/622,297 filed on Apr. 10, 2012.

FIELD OF THE INVENTION

The present invention is generally directed to altering electrical and thermal properties of resistive materials, in particular, to methods that may combine different types of trimming to electrically and thermally stabilize the resistance of resistors.

BACKGROUND INFORMATION

Precision resistors by definition require a defined precision resistance. However, without special treatment, the resistance of the resistor varies substantially with environmental parameters. Specifically, when electrical power is applied to a resistor such as a Silicon Chromium (SiCr) Thin Film resistor, the heat generated by the power passing through the resistor substantially decreases the resistance of the resistor. FIG. 1 illustrates a resistance curve of an untrimmed resistor as a function of power applied to the resistor. As shown in FIG. 1, the resistance may decrease substantially as the power applied to the untrimmed resistor increases. This is due to an increase in dissipated power in the resistor, that results in an rise in the resistors junction temperature. As temperature increases, there is an increase in free electron density in the heated resistor and thus the resistance decrease. The amount of resistance change as a function of power may be characterized by a power coefficient of resistance (PCR) which may be defined as $PCR=\Delta R/\Delta P$, where $\Delta P$ is the power change and $\Delta R$ is the resistance change. PCR corresponds to the slope of the resistance curve. A related parameter of the resistor is the temperature coefficient of resistance (TCR) which may be defined as $TCR=\Delta R/\Delta T$, where $\Delta T$ is the temperature change and $\Delta R$ is the resistance change.

In practice, a resistor is usually designed to have an absolute resistance value R which is ideally substantially constant with respect to the changes of power that passes through the resistor or the temperature on the resistor body. Thus, it is not desirable to have a resistor whose resistance varies over the power applied to it. One way to create a robust resistor that has no or very little resistance variability over power variations is to apply special treatments such as resistor trimming to the resistor before deployment. Resistor trimming is a process that stabilizes the resistance value of a resistor within a precision range. The resistance of a resistor may be trimmed in different ways. For example, current art may include current trim (ITrim), laser trim, or mechanical trim. Each of these trimming methods may have their respective characteristics. However, after trimming, the resistance of the resistor may stay within a certain range of an absolute resistance. FIG. 2 illustrates a comparison of the resistance curves of a resistor before and after trimming using the Itrim method. FIG. 2 shows that the resistance-over-power curve of a trimmed resistor may not reduce as dramatically as an untrimmed resistor.

Current art commonly employs a single particular trimming approach to trim the resistor. Because of the limitation of each particular trimming approach, it is difficult to achieve a high precision resistor using the current art. Therefore, there is a need to improve the current art to achieve high precision resistors.

DETAILED DESCRIPTION OF EXAMPLE EMBODIMENTS

Figure 1:
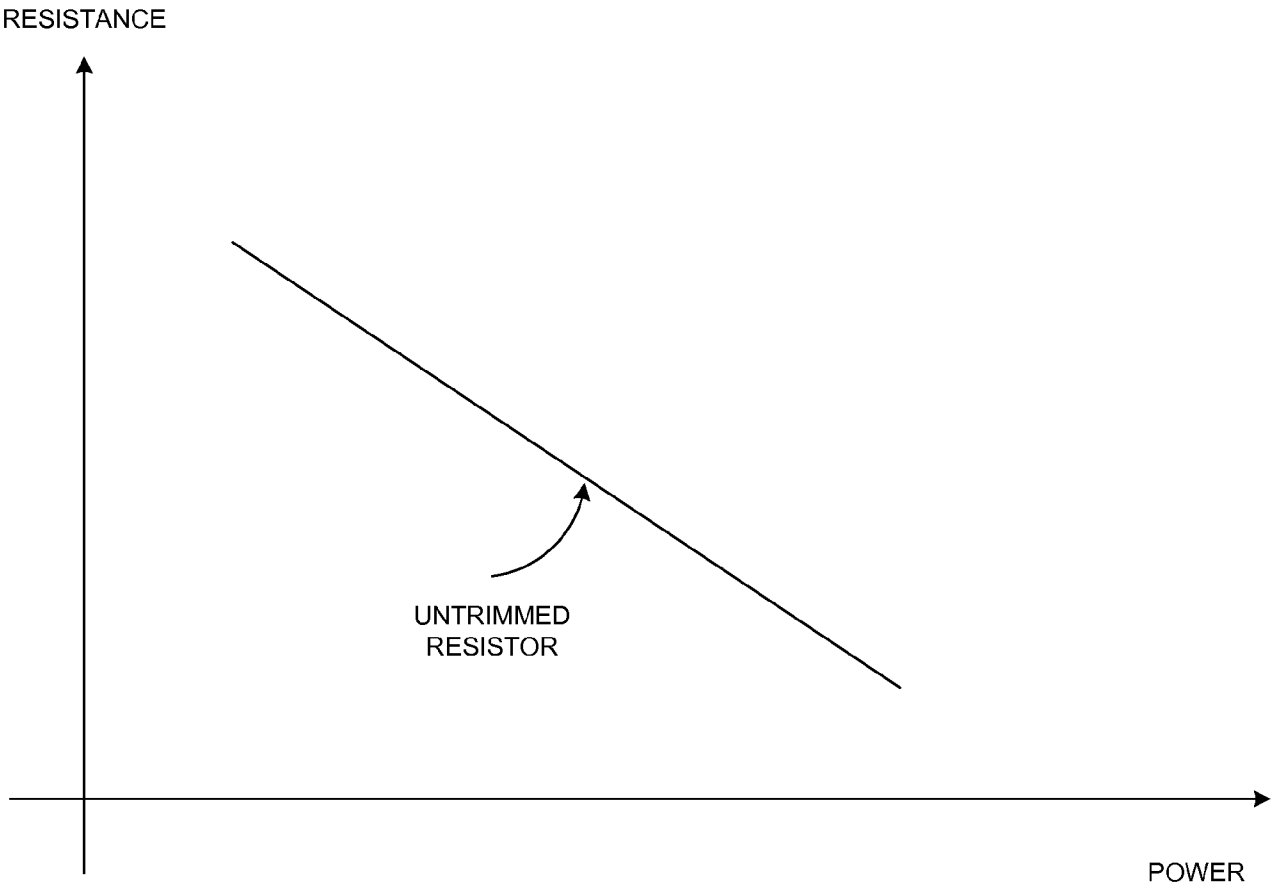
FIG. 1 illustrates a resistance-over-power curve of a resistor without trimming.
Figure 2:
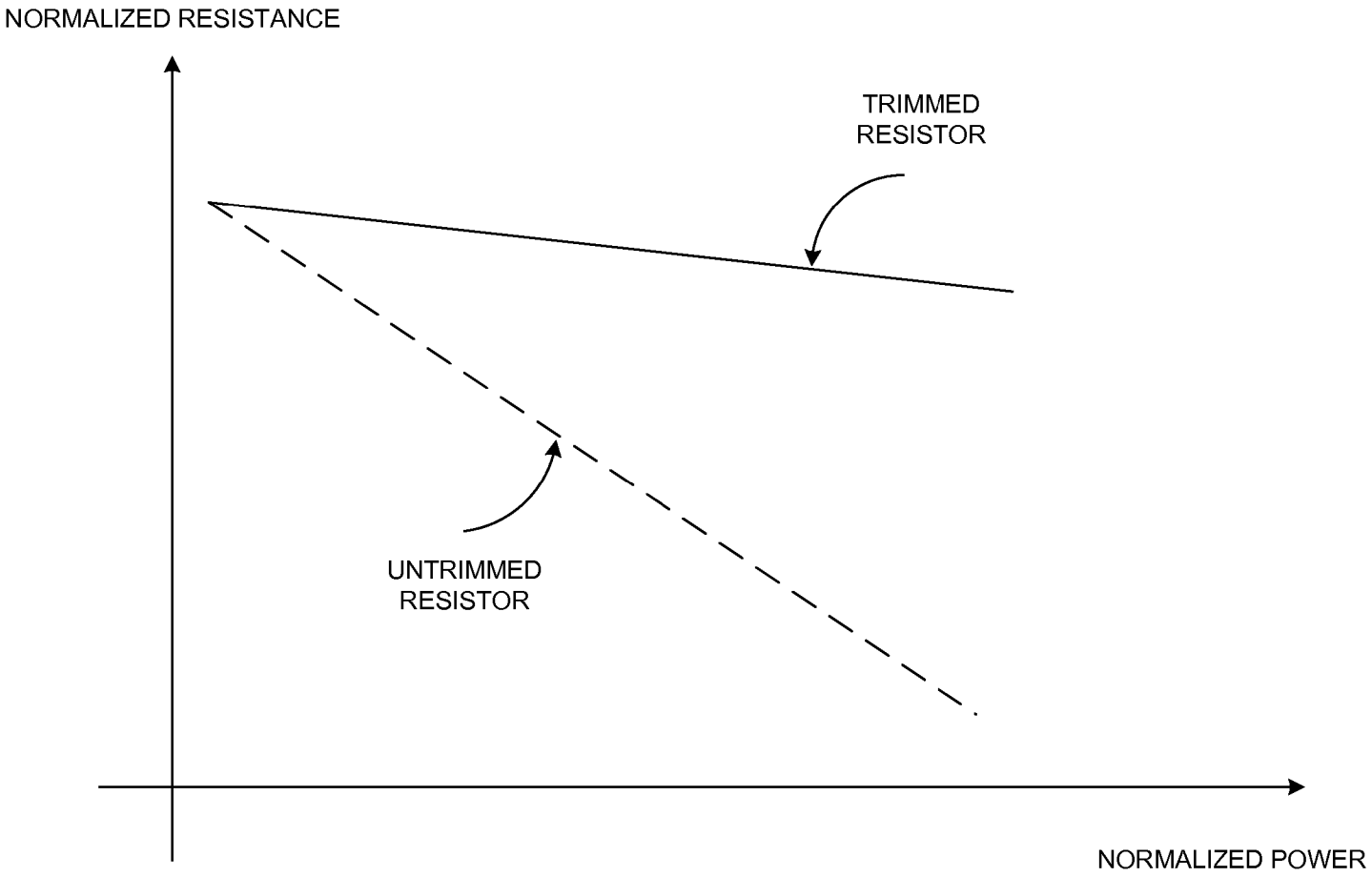
FIG. 2 illustrates a comparison of resistance-over-power curves of trimmed and untrimmed resistors.

Current trim (ITrim) may be used to trim a resistor so that the resistance of the resistor may stay substantially constant when electric power is applied to the resistor. ITrim is a method to trim a resistor by changing the phase/state of the resistive material of the resistor by electrically stressing the resistive material, resulting in changes in terms of electrical and thermal parameters such as PCR, TCR, Voltage Coefficient of Resistance (VCR), thermal conductivity, and the absolute resistance of the resistive material. The electrical stressing may be achieved by applying a current bias to the resistive material. For example, a SiCr thin film resistor may be heated by an electrical stress as a result of the self/joule heating from applying a current bias to the resistor. The heat generated by the self/joule heating may cause a region of the resistor to become a hot spot having a temperature in the range of 500-1000° C. At such high temperatures various migration mechanisms are activated, resulting in the mobilization of elements such as Si and Cr atoms. In regions depleted of Si, the resistive material may change from a more resistive material to a less resistive material that has a more positive TCR. This positive TCR (less resistive material) region may balance the remaining negative (more resistive material) TCR region so that the resistance of the resistor may stay relatively stable when temperature rises.

In practice, the trim time (or time for applying the current bias) and amplitude of the electrical stress may be determined in accordance with the PCR of the resistor. At the beginning, a low power bias sweep may be applied to the resistor to characterize the resistor. This first characterization sweep may increase the self/joule heating of the resistor and thus result in a negative slope in a resistance versus power plot for the resistor (which was untrimmed beforehand). Based on the first characterization sweep's slope, a controlled electrical bias may be calculated and applied to trim the resistor. After the first characterization and electrical stress step, a second characterization may be applied to the resistor. If the characterization sweep's slope is still negative, an increased electrical bias may be applied to the resistor, which may be followed by a third characterization sweep. This interactive process may be continued until a near zero PCR slope is found, which corresponds to a near 0 ppm TCR. Thus, the Itrim process includes a series of characterization and electrical stress steps. Although Itrim may change the resistive material phase/state to substantially close of zero PCR or TCR, Itrim, at the same time, also reduces the absolute resistance of a resistor. The resistance reduction may be undesirable for certain applications.

Laser trim is a method that uses laser beams to heat up and reconfigure areas of a resistor such as portions of the resistive film in SiCr thin film resistor. The reconfiguration may include removing part of the resistor or separating portions of the resistor. The reconfiguration of areas of the resistor may controllably increase the absolute resistance of the resistor, while inflicting no or minimal effect on the PCR or TCR of the resistor.

Embodiments of the present invention may combine the Itrim with the laser trim to achieve a resistance-stabilized resistor that has a desired resistance value. Embodiments of the present invention may include applying a first laser trim to a resistor until a resistance of the resistor is higher than a target resistance by a predetermined percentage, applying current trims to the resistance until the PCR of the resistor is substantially close to zero, applying a second laser trim to the resistor until the resistance of the resistor is within a precision range of the target resistance.

Embodiments of the present invention may include a computer system including a hardware processor that is configured to a method for altering a resistance of a resistor. The method may include trimming the resistor using a first type of trim approach to increase a resistance measurement of the resistor to above a target resistance value, iteratively trimming the resistor using a second type of trim approach until PCR or TCR of the resistor is substantially close to zero, measuring the resistance of the resistor, and if the resistor measurement is lower than the target resistance value, trimming the resistor using the first type of trim approach until the resistance of the resistor is substantially close to the target resistance value. The first type of trim approach increases the resistance of the resistor, while the second type of trim approach decreases the resistance of the resistor.

Embodiments of the present invention may include a system for altering a resistance of a resistor. The system may include a first trim module for trimming the resistor to increase a resistance measurement of the resistor to a target resistance value, and iteratively trimming the resistor using a second type of trim approach until a temperature coefficient of resistance (TCR) measurement of the resistor is substantially close to zero.

Figure 3:
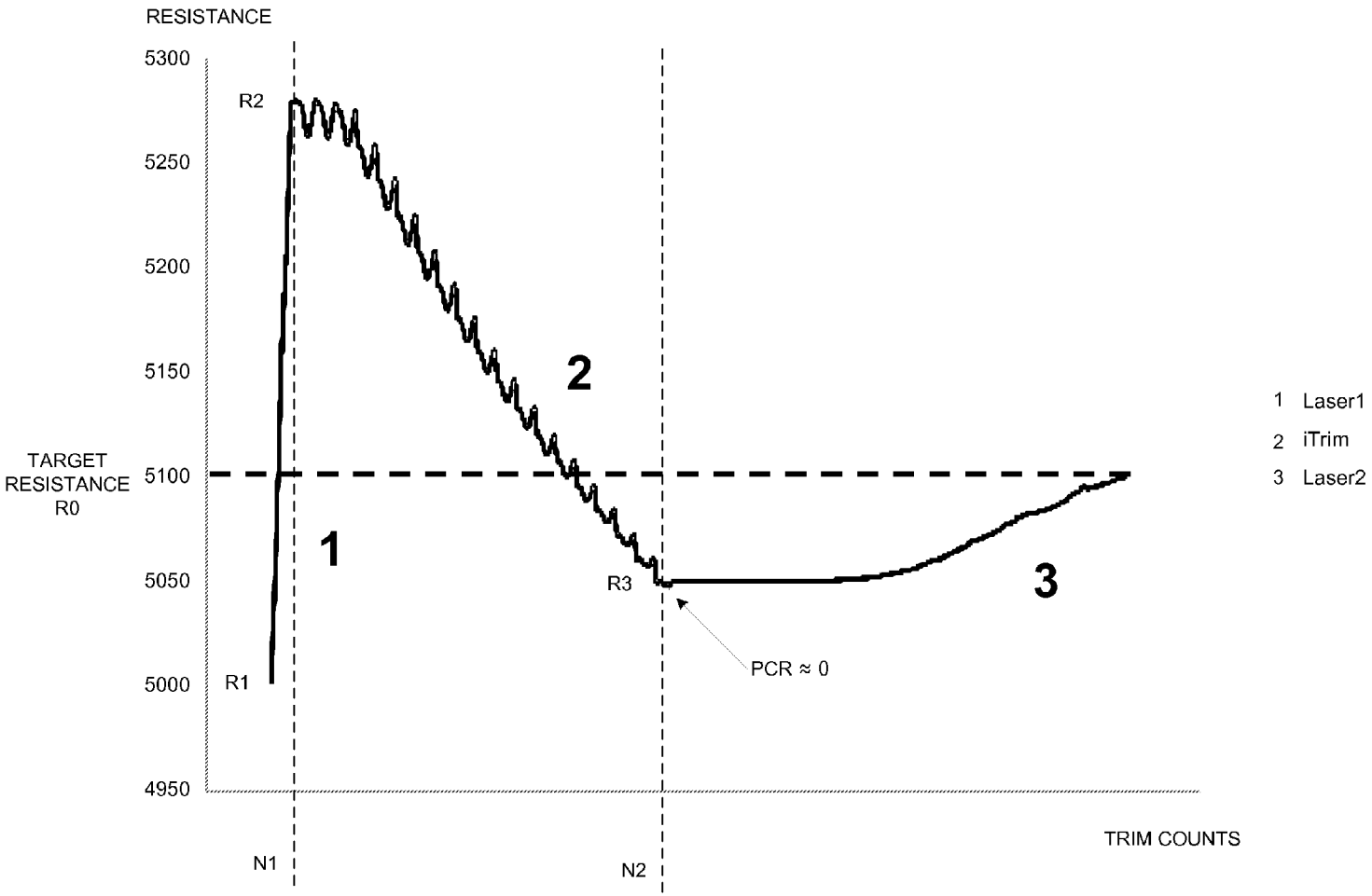
FIG. 3 illustrates a resistance curve of combining two types of trimming approaches to achieve high precision resistors according to an exemplary embodiment of the present invention.

FIG. 3 illustrates a resistance curve of combining laser trims and current trims to achieve high precision resistors according to an embodiment of the present invention. The abscissa represents trim counts, while the ordinate represents resistance value of a resistor. In the first trim period (from 0 to N1 trim counts), a laser trim may be used to increase the resistance from R1 to R2, where R2 is higher than the target resistance R0, and R2 is a predetermined resistance value.

In the second trim period (from N1 to N2 trim counts), Itrims may be used to change the phase/state of the resistive material until the PCR (or TCR) is near zero. The Itrim process may includes a series of characterization and electrical stressing steps. During a characterization, the PCR (or $\Delta R/\Delta P$) or TCR (or $\Delta R/\Delta T$) of the resistive material may be measured. If the measured PCR (or TCR) is not near zero, the time and amplitude of a current bias to be applied to the resistor is determined based on the measured PCR (or TCR). The determined current bias is then applied to the resistor to exert electrical stress to the resistor. After the exertion of the electrical stress, another characterization may be applied to the resistor to again measure the PCR (or TCR) of the resistor. If the measured PCR (or TCR) is still not near zero, the time and amplitude of another current bias may be determined based on the measured PCR (or TCR). The determined current bias may again be applied to the resistor. The characterization and electrical stress steps may continue until the PCR (or TCR) is zero or near zero. As discussed above, Itrim may adjust PCR (or TCR), but may also undesirably decrease the absolute resistance of the resistor. Referring to FIG. 3, the resistance value after Itrim steps may reach R3 which may be lower than the target resistance R0. In the third trim period (N2 and above trim count), an optional laser trim may be used to increase the absolute resistance of the resistor to the target value without effecting the region of the resistor trimmed by the Itrim technique if R3 is lower than R0.

Figure 4:
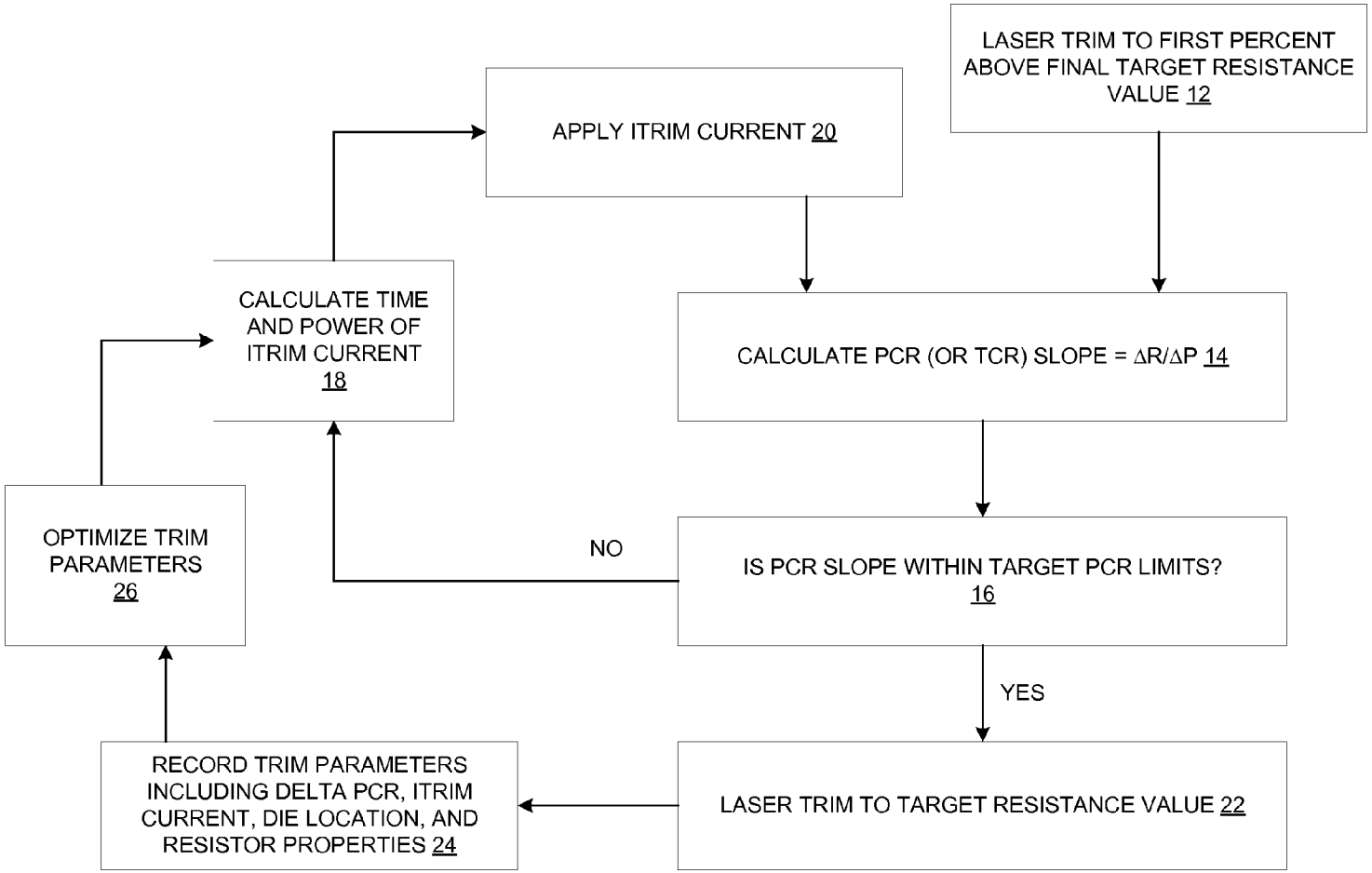
FIG. 4 illustrates a flow diagram of combining two types of trimming approaches to achieve high precision resistors according to an exemplary embodiment of the present invention.

FIG. 4 is a detailed flow diagram of combining two types of trimming approaches to achieve high precision resistors according to an exemplary embodiment of the present invention. Referring to FIG. 4, at 12, a resistor may be laser trimmed to a first resistance value which is at a first percentage higher than a target resistance value. For example, the resistor may be trimmed by laser trim to 3 to 10% higher than the target resistance value. At 14, via a characterization process, the PCR (or TCR) may be calculated. At 16, it is determined whether the calculated PCR (or TCR) is zero or near zero. If not, at 18, a time and amplitude of electrical current to be applied to the resistor is determined through a model based on the calculated PCR (or TCR). At 20, the determined current may be applied to the resistor to exert an electrical stress on the resistor. The exerted electrical stress may change the phase/state of the resistor material. After the electrical stress exertion, another characterization may be applied to the resistor to determine the PCR (or TCR) of the resistor. Thus, steps 14, 16, 18, and 20 may form an iterative Itrim process that may change the phase/state of the resistor through electrical stress until the the PCR (or TCR) is zero or near zero. If it is determined at 16 that the PCR (or TCR) slope is zero or near zero, at 22, a laser trim may be again applied to the resistor to raise the resistance to the target value.

Embodiments of the present invention may further include, at 24, recording trim parameters used during the laser trim and Itrim. The recorded parameters may include PCR (or TCR) changes in response to current biases, die location, and properties relating to the resistor. At 26, the model for calculating time and amplitude of Itrim current may be optimized based on the recorded parameters. The optimization may be achieved through experience function, neuron network or other optimization methods.

Embodiments of the present invention may include a system that may include hardware modules for carrying out the laser trim and Itrim. The laser trim module may include a platform on which the resistor to be trimmed is placed, a laser beam generator for generating the laser, and a processor configured to control the amount of laser applied to the resistor. The Itrim module may also include a platform on which the resistor to be trimmed is place, a current generator circuit for generating the trim current, and the processor that is configured to control the duration and amplitude of the generated current.

Those skilled in the art may appreciate from the foregoing description that the present invention may be implemented in a variety of forms, and that the various embodiments may be implemented alone or in combination. Therefore, while the embodiments of the present invention have been described in connection with particular examples thereof, the true scope of the embodiments and/or methods of the present invention should not be so limited since other modifications will become apparent to the skilled practitioner upon a study of the drawings, specification, and following claims.

What is claimed is:

1. A method for altering an absolute resistance of a resistor, comprising:

trimming the resistor using a first type of trim approach to increase an absolute resistance measurement of the resistor to above a target resistance value; and iteratively trimming the resistor using a second type of trim approach until an absolute value of a power coefficient of resistance (PCR) measurement pertaining to the absolute resistance of the resistor is substantially close to a predetermined value.

2. The method of claim 1, further comprising:

measuring the absolute resistance of the resistor; and if the absolute resistance measurement is lower than the target resistance value, trimming the resistor using the first type of trim approach until the absolute resistance measurement of the resistor is substantially close to the target resistance value.

3. The method of claim 2, wherein the first type of trim approach is laser trimming.

4. The method of claim 2, wherein the second type of trim approach is current trim.

5. The method of claim 4, wherein one of a duration and amplitude of each current trim is determined based on a model that is characterized by a set of parameters.

6. The method of claim 5, wherein the parameters include at least one of a PCR change, a duration of the trim current, an amplitude of the trim current, and a die location.

7. The method of claim 6, further comprising:

recording the parameters for each current trim; and optimizing the model based on the recorded parameters.

8. A system for altering an absolute resistance of a resistor, comprising:

a first trim module for trimming the resistor to increase an absolute resistance measurement of the resistor to a target resistance value; and a second trim module for iteratively trimming the resistor until an absolute value of a power coefficient of resistance (PCR) measurement pertaining to the absolute resistance of the resistor is substantially close to a predetermined value.

9. The system of claim 8, wherein the absolute resistance of the resistor is measured after the iterative trimming of the resistor, and if the absolute resistance measurement is lower than the target resistance value, the resistor is trimmed by the first trim module until the absolute resistance measurement of the resistor is substantially close to the target resistance value.

10. The system of claim 9, wherein the first trim module uses laser trim.

11. The system of claim 9, wherein the second trim module uses current trim.

12. The method of claim 1, wherein the predetermined value is one of zero and a value near zero.

13. The method of claim 1, wherein during the iteratively trimming using the second type of trim approach, the absolute resistance measurement of the resistor is in a decreasing trend.

14. The method of claim 1, wherein the iterative trimming of the resistor includes a series of characterization and electrical stressing steps.

15. The method of claim 14, wherein the absolute resistance measurement of the resistor increases during characterization and decreases during electrical stressing during each characterization and stressing step.

16. The system of claim 8, wherein the predetermined value is one of zero and a value near zero.

17. The system of claim 8, wherein during the iteratively trimming using the second type of trim approach, the absolute resistance measurement of the resistor is in a decreasing trend.

18. The system of claim 8, wherein the iterative trimming of the resistor includes a series of characterization and electrical stressing steps.

19. The system of claim 18, wherein the absolute resistance measurement of the resistor increases during characterization and decreases during electrical stressing during each characterization and stressing step.

* * * * *